United States Patent [19]

Seragnoli et al.

[11] Patent Number: 4,489,631

[45] Date of Patent: Dec. 25, 1984

[54] FEED DEVICE FOR LABELS

[75] Inventors: Enzo Seragnoli; Riccardo Mattei, both of Bologna, Italy

[73] Assignee: G. D Societa' per Azioni, Bologna, Italy

[21] Appl. No.: 448,218

[22] Filed: Dec. 9, 1982

[30] Foreign Application Priority Data

Dec. 22, 1981 [IT] Italy ..... 3614 A/81

[51] Int. Cl.[3] ..... B65H 17/40

[52] U.S. Cl. ..... 83/278; 83/281; 83/422

[58] Field of Search ..... 83/278, 276, 281, 422

[56] References Cited

U.S. PATENT DOCUMENTS

| | | | |
|---|---|---|---|
| 1,859,372 | 5/1932 | Mutschler | 83/278 |
| 2,009,869 | 7/1935 | Beekman | 83/278 X |
| 2,677,477 | 5/1954 | Eisengrein et al. | 83/278 X |
| 2,721,612 | 10/1955 | Almgren | 83/278 X |
| 2,725,101 | 11/1955 | Von Hofe | 83/278 X |
| 3,435,717 | 4/1969 | Macomber | 83/278 X |

*Primary Examiner*—Frank T. Yost

*Attorney, Agent, or Firm*—Marshall, O'Toole, Gerstein, Murray & Bicknell

[57] ABSTRACT

A device for feeding labels in a strip to a utilizer machine, the device being modifiable to permit the supply of labels stacked in a magazine; the modifications comprise the elimination of a fixed cutting blade and its replacement by a fixed magazine for the labels and an extractor device for extracting these from the magazine; the extractor device is mounted on a reciprocating slide carrying means for incrementally advancing the said strip.

5 Claims, 5 Drawing Figures

Fig.1
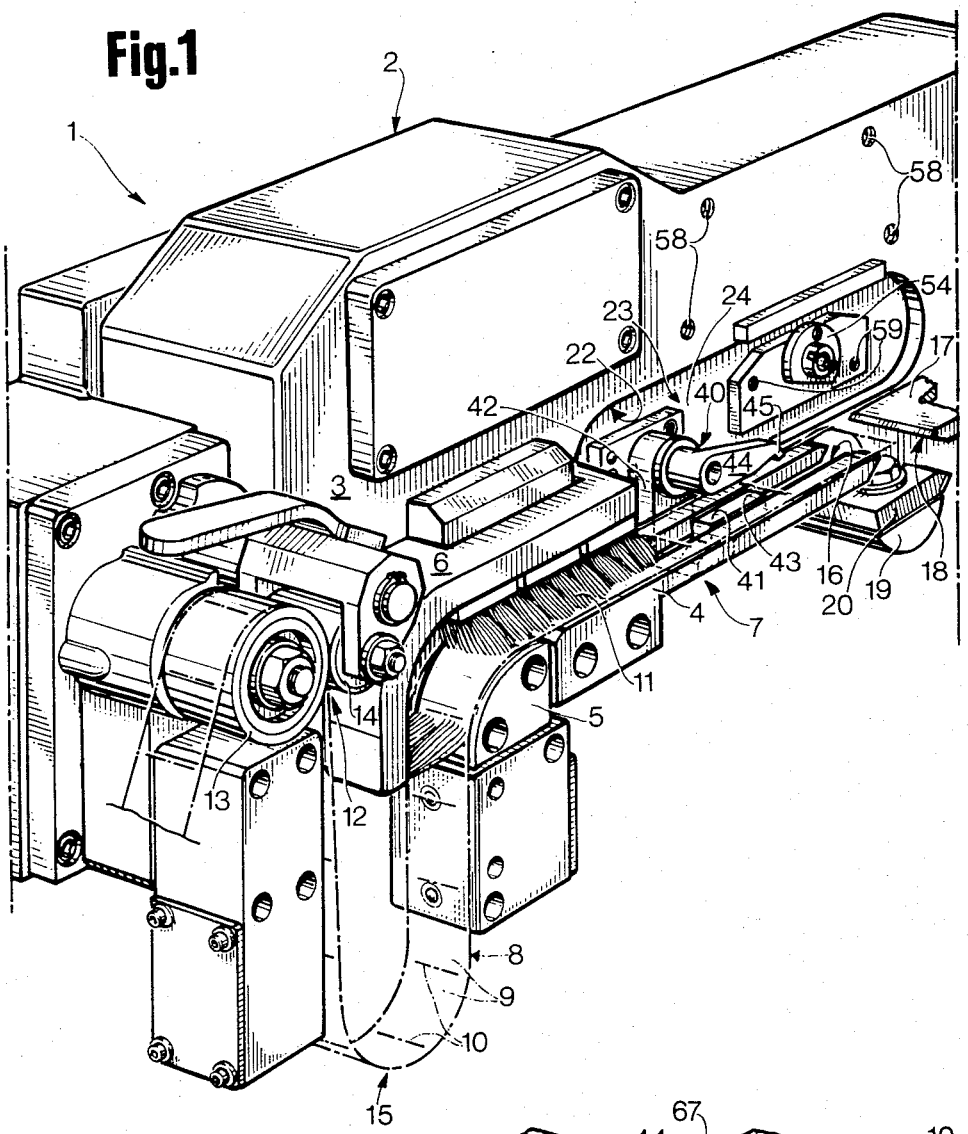
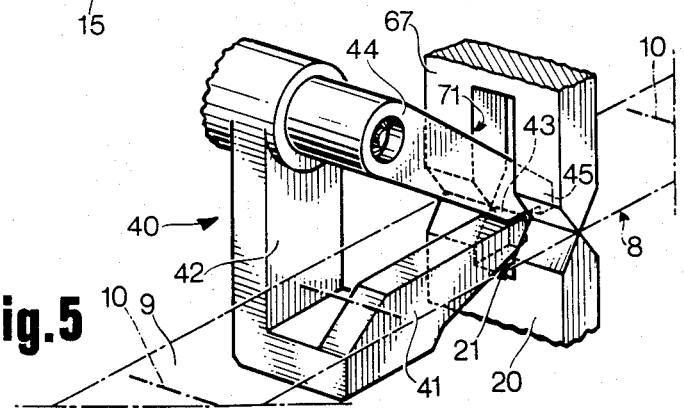
Fig.5

Fig.4
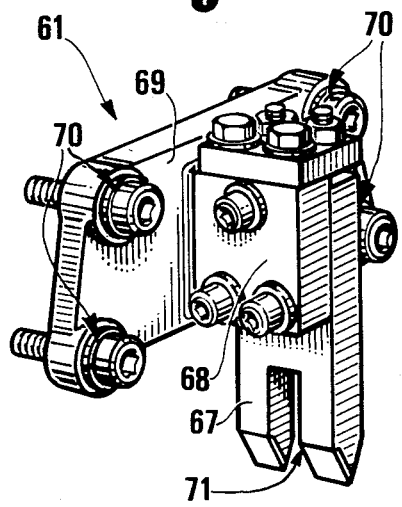
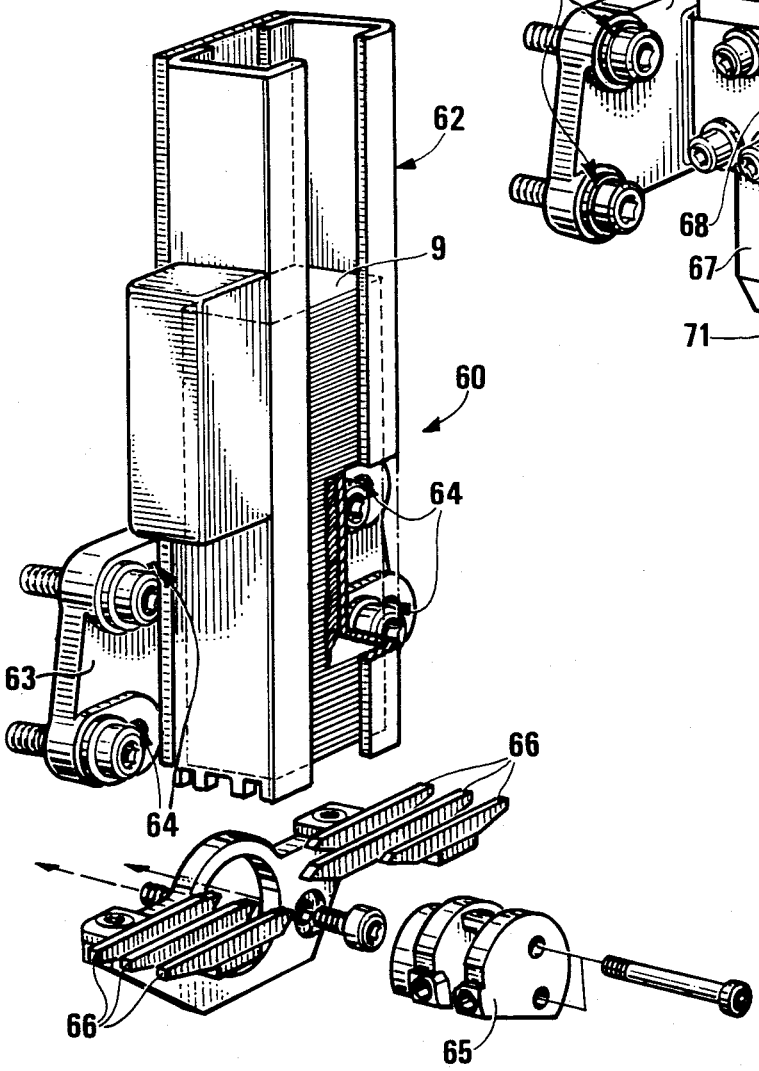
Fig.3

FEED DEVICE FOR LABELS

BACKGROUND OF THE INVENTION

The present invention relates to a feed device for labels, usable in a particularly advantageous manner on cigarette packaging machines for supplying to a packaging line labels comprising, for example, country stamps or sealing strips. Labels of the above described type are normally obtained either by cutting a continuous web or else by extracting from a stack of individual labels. Obviously, the machines utilising these labels are equipped with feed devices which are rather different depending on the labels obtained in one or the other of the two ways described above. The arrival on the market of utiliser machines having ever higher productivity has involved the necessity of being able to convert swiftly from one type of production to another for the purpose of fully exploiting the utiliser machine itself. A utiliser machine may in fact be used for a certain time for a production of articles intended for the home market, which require, for example, country stamps formed from a continuous strip, and for a certain other time for the production of articles intended for export, which are identified, for example, by country stamps or sealing strips provided in the form of individual labels. Obviously, the conversion from one type of production to the other on the same machine is economically justifiable only when it is possible to adapt the machine itself to a new type of production in a relatively short time.

Up to now there have only been known utiliser machines, in particular cigarette packaging machines, provided with feed devices operable to take labels from a continuous strip or else withdraw them from the bottom of a column-type magazine, and on which the conversion from one type of feed to the other is possible only by substituting all the associated feed devices.

SUMMARY OF THE INVENTION

The object of the present invention is that of providing a feed device which will permit the conversion from a strip type of feed to a feed of individual labels superimposed in the form of a stack, and vice versa, in a relatively short time. In particular, the object of the present invention is that of providing a feed device which will be adaptable to one or the other of the said two systems by replacing an extremely limited number of elements and which can be effected in a relatively short time.

The said object is achieved by the present invention in that it relates to a label feed device, in particular for feeding country stamps or sealing strips to a utiliser machine, in particular a cigarette packaging machine, characterised by the fact that it comprises, in combination, a support body, a track for advancement of a continuous strip of labels extending along the said support body and including an input portion and an output portion aligned with one another and together defining a separation slot, a slide mounted on the said support body in a position adjacent the said track and movable with a reciprocating movement along it, an advancement device carried by the said slide and operable to cooperate with the said strip to cause its advancement along the input portion of the said track, a hollow shaft rotatably carried by the said slide and movable with a rotary reciprocating movement about its own axis in a determined phase relation with the movement of the said slide, a cutting element supported by the said support body in a position adjacent the said slot and rotatable about its own axis with a determined phase relation with the movement of the said slide, and two auxiliary units selectively connectable to the said support body in positions facing the said slot; one of the said units including a fixed cutting element which can be disposed facing the said slot and having a cutting edge tangential both to the said track and to the path of the said rotary cutting element; and the other said unit including a fixed magazine for the labels, which can be disposed facing the said slot, and a rotary extractor element for the said labels keyed onto the said hollow shaft and movable with this latter in the space lying between one end of the said magazine and the said track; the said extractor element being connectable to a suction device by the said hollow shaft.

BRIEF DESCRIPTION OF THE DRAWINGS

Further characteristics and advantages of the present invention will become apparent from the following description with reference to the attached drawings, which illustrate various non-limitative embodiments thereof, in which:

FIG. 1 is a perspective view, with parts removed for clarity, of a label feed device formed according to the principles of the present invention;

FIG. 3 is a perspective view of a first auxiliary unit connectable to the device of FIG. 1;

FIG. 4 is a perspective view of second auxiliary unit connectable to the device of FIG. 1 as an alternative to the unit of FIG. 3; and FIG. 5 is a perspective view of a particular operative position of the unit of FIG. 4 mounted on the device of FIG. 1.

DETAILED DESCRIPTION OF THE INVENTION

Figure 2:
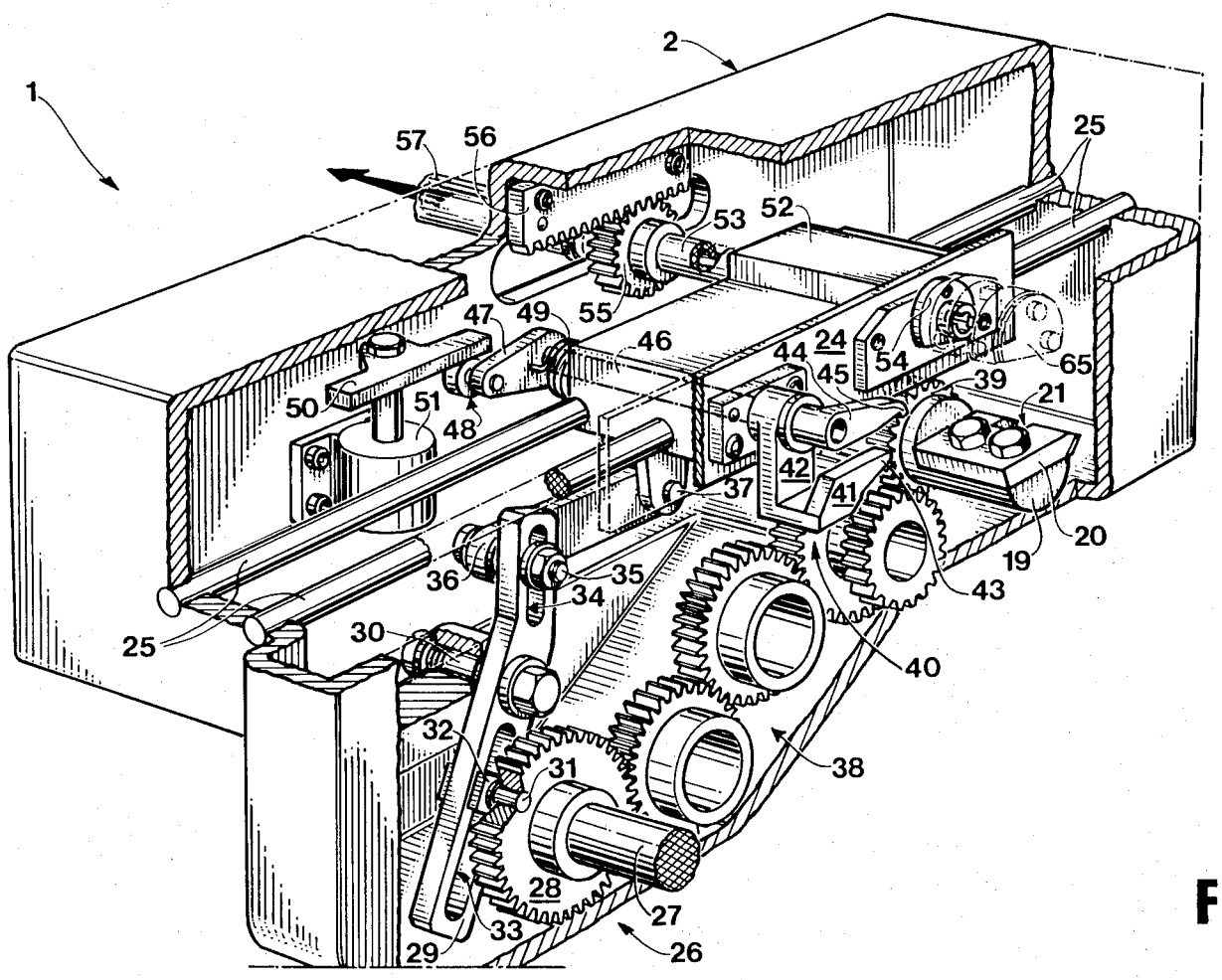
FIG. 2 is a schematic and perspective view of the inner drive mechanism of the device of FIG. 1.

FIG. 1 illustrates a feed device 1 for labels, in particular country stamps or sealing strips, to a cigarette packaging machine not illustrated. The device 1 includes an outer casing 2 of substantially prismatic form having laterally a front substantially vertical flat wall 3.

To the outer surface of the wall 3 is connected a plate 4 disposed perpendicularly to the wall 3 and having a substantially rectangular plan form. A longitudinal end of the plate 4 is disposed in contact with a block 5 having a convexly curved surface joining the upper surface of the plate 4 and facing a curved input section of a plate 6 extending above the plate 4 to define, with this latter, an input portion of a guide or advancement track 7 for a strip 8 illustrated in broken outline in FIG. 1. The strip 8 is constituted by a plurality of labels 9 partially separated from one another by transverse cuts 10 extending from a central portion of the strip 8.

An end portion of the strip 8 disposed along the guide 7 is maintained in contact with the surface of the plate 4 by means of a braking device constituted by a brush 11 extending from the lower surface of the plate 6. The opposite end (not illustrated) of the strip 8 is wound onto a reel (not illustrated) at the output of which is disposed an unwinding device 12 including a motorised roller 13 and a pressure roller 14, which grip the strip 8 between them and unwind it from the said reel in such a manner as to form a loop or reserve 15.

The plate 4 has an axial slot 16 one end of which is open outwardly and faces a second plate 17 coplanar with the plate 4. The plate 17 constitutes an output portion of the track or guide 7 and is separated from the plate 4 by a slot 18 transverse to the slot 16 and perpendicular to the wall 3. Through this latter is mounted a rotary shaft 19 carrying a rotary blade or cutting element 20 connected thereto, which can move into the slot 18 so that its cutting edge is in a position tangential to the plane of the guide 7. The cutting edge of the blade 20 is subdivided into two parts by a central recess 21 the width of which is substantially equal to that of the slot 16.

A window 22 of substantially rectagular form is formed in the wall 3, the axis of the rectangle extends over the plates 4 and 17 and parallel thereto. The window 22 is closed by a front surface 23 of a slide 24 mounted within the casing 2 and movable with a reciprocating movement along the guide 25 parallel to the plates 4 and 17.

As illustrated in FIG. 2, the slide 24 is coupled to a drive device generally indicated 26 and including an input shaft 27 connected to a motor (not illustrated) and a gear 28 keyed on the shaft 27 and serving as the crank of a crank and slotted link 29 pivoted at 30 on the casing 20. To this end the gear 28 is provided with an eccentric pin 31 on which is rotatably mounted a slide 32 slidably coupled to a longitudinal slot 33 of the link 29. This latter has, at an upper end, a slot 34 within which is fixed, in a transversely adjustable position, a pin 35 for attachment of a connecting rod 36 pivoted, at its opposite end, to a pin 37 carried by the slide 24.

The gear 28 constitutes the input of a drive train 38 the output of which is constituted by a gear 39 keyed to the shaft 19, and the function of which is to rotate the shaft 19 in a determined phase relation with the to-and-fro displacements of the slide 24. To the slide 24 is connected a pincer advancement device 40 for the strip 8, which comprises a pusher element 41 rigidly connected to a bracket 42 fixed with respect to the slide 24 and having a substantially L-shape form. The bracket 42 has a first arm extending between the plate 4 and the wall 3 and a second arm extending below the plate 4, whilst the pusher element 41 extends obliquely upwardly from the end of the said second arm and slidably engages in the slot 16. In particular, the element 41 terminates at its upper end with an edge 43 disposed coplanar with the upper surface of the plate 4. The device 40 includes, as well as the bracket 42 and the pusher element 41, a retractor element 44 disposed above the pusher element 41 and having a tooth 45 projecting beyond the edge 43. The retractor element 44 is keyed to the end of a shaft 46 mounted rotatably through the slide 24 and disposed perpendicularly to the wall 3. To the opposite end of this shaft 46 from that connected to the retractor element 44 the shaft 46 is rigidly connected to a crank 47 provided with a cam follower roller 48 which is pressed by a spring 49 into contact with a cam 50. This latter is connected to an actuator device 51, which imparts to the cam 50 a reciprocating translation movement in a determined phase relation with the movement of the slide 24 in such a way as to turn the retractor element 44 about the axis of the shaft 46 according to a predetermined law which will be specified below.

At one end of the slide 24 opposite that facing the unwinding device 12 is connected a support 54 rotatably traversed by a tubular shaft 53 parallel to the shaft 46 and carrying, at its end projecting from the window 22, an attachment flange 54. At the opposite end the shaft 53 has keyed to it a toothed wheel 55 meshing with a rack 56 rigidly connected to the casing 2.

On the end carrying the toothed wheel 55 the shaft 53 has connected thereto a flexible duct 57 communicating with a suction device not illustrated. Through the wall 3 of the casing 2 across the lateral surface 23 of the slide 24 there are formed two series of holes respectively indicated 58 and 59 which permit the assembly of one or the other of two auxiliary units generally indicated 60 and 61 and illustrated respectively in FIGS. 3 and 4.

The units 60 and 61 are respectively usable in dependence on whether the labels 9 are provided in the form of individual pieces superimposed over one another in the form of a stack, or else in the form of a continuous strip.

The unit 60 includes a magazine 62 having an axis perpendicular to the plane of the plate 4 and rigidly connectable to the wall 3 above the slot 18 by means of a plate 63 provided with holes 64 which can be positioned to coincide with the holes 58. The magazine 62 can receive a stack of labels 9 disposed superimposed over one another and removable one by one from a lower open end of the magazine 62 by means of an extractor element constituted by a suction roller 65 rigidly connectable to the flange 54 for transverse movement with the slide 24 together with two series of strips 66 connectable to the slide 24 in correspondence with the holes 59.

The strips 66 are disposed on opposite sides of the roller 65 and can move with a reciprocating movement along a plane tangential both to the periphery of the roller 65 and to the lower open end of the magazine 62. The unit 61 includes a blade or fixed cutting element 67 rigidly connectable to the wall 3 by means of a bracket 68 provided with an attachment plate 69 substantially identical to the plate 63. Similarly, the plate 69 is provided with holes 70 which can be matched up with the holes 58, and can be disposed above the slot 18 in such a way as to support the blade 67 in a radial position with respect to the shaft 19 and with a cutting edge disposed tangentially both to the plane of the track 7 and to the circular path followed by the cutting edge of the blade 20.

Similarly, the fixed blade 67 has, starting from its cutting edge, a longitudinal recess 71 which can match with the recess 21 and is of a width equal to that of this latter and slightly greater than that of the separator element 44 of the pusher element 41. The operation of the feed device 1 will now be described in the first place in combination with the unit 60 and secondly in combination with the unit 61.

When the labels 9 are provided in the form of individual labels superimposed to form a stack, the feed device 1 is completed by mounting the unit 60 by disposing the plate 63 of the magazine 62 with its holes 64 in coincidence with the holes 58 of the walls 3 and connecting the plate 63 to this latter by means of screws.

Subsequently, the strips 66 are connected to the slide 24 by means of screws engaged in the holes 59. The assembly of the unit 60 is completed by connecting the suction roller 65 by screws to the attachment flange 54 of the tubular shaft 53.

In use, one rotation of the shaft 27 corresponds, given the presence of the oscillating rank and slotted link 29 to one reciprocating movement of the slide 24 along the guide 25 and a consequent reciprocating displacement of the suction roller 65 and the strips 66 beneath the lower end of the magazine 62. Because of the coupling between the toothed wheel 55 keyed on the tubular shaft 53 and the rack 56, one to-and-fro displacement of the slide 24 corresponds to a to-and-fro rotation of the suction roller 65 about its axis.

In particular, during the displacement of the slide 24 towards the plate 17, the suction roller 65 turns (in an anti-clockwise sense in FIG. 3) beneath the bottom of the magazine 62 in such a way as to draw from this latter, with the aid of the strips 66, a label 9 which, at the end of the stroke of the slide 24 is deposited on the plate 17 immediately before the slide 24, upon returning back towards the plate 4, carries the suction roller 65 to an initial position for a new cycle of withdrawal. Simultaneously with the movement of the slide 24 the shaft 27 drives, by means of the drive train 38, the shaft 19 supporting the rotary blade 20.

Moreover, advancement device 40 also moves with a reciprocating movement carried by the slide 24, whilst the elements 41 and 44 move with respect to one another according to a law determined by the actuator device 51 as will be better explained below. However, the rotary blade 20 and the advancement device 40 have only a minimum influence on the advancement of the label 9 withdrawn from the bottom of the magazine 62 and can consequently be left mounted on the device 1 without creating any disadvantage.

On the other hand, the rotary blade 20 and the advancement device 40 act when the labels 9 are provided in the form of a strip 8 wound in such a way as to form a reel not illustrated supported on a reel-carrier arm not illustrated and disposed upstream of the unwinding device 12. In this case, the unit 61 is mounted in place of the unit 60, the unit 61 being constituted solely by the fixed blade 67 and the associated plate 69 which is disposed with its holes 70 in coincidence with the holes 58 of the wall 3 and fixed to this latter by means of screws. In use, the strip 8 is unwound from the associated reel and introduced first beneath the rollers 13 and 14 of the unwinding device 12 and then beneath the plate 6 after having formed the loop or reserve 15.

The free end of the strip 8 is then made to advance along the plate 4 until the first of its perforations 10 is disposed downstream of the edge 43 of the pusher element 41.

Supposing that the slide 24 is located at the end of its stroke towards the unwinding device 12, the driving of the shaft 27 involves, via the reciprocating slotted link mechanism 29, a displacement of the slide 24 and of the advancement device 40 connected to it towards the plate 17.

During this displacement the actuator device 51 maintains the cam 50 in a raised position permitting the separator element 44 to be maintained in a position displaced towards the pusher element 41 and the associated tooth 45 to be displaced along within the slot 16. Consequent on what has been described above, the tooth 45 engages the upper surface of the strip 8 immediately downstream from the previously mentioned perforation 10, and displaces the edge of it downwardly towards the pusher element 41. This latter, upon advancing, engages with its edge 43 the said lowered edge of the perforation causing the advancement of the strip 8 and the consequent reduction in the reserve 15 which is immediately renewed, with continuous movement, by the unwinding device 12. The stroke of the slide 24 as it moves away from the unwinding device 12 ends when the edge 43, moving along the slot 16 and maintaining itself coplanar with the surface of the plate 4 in contact with the strip 8, reaches the cutting edge of the fixed blade 67. It is possible for it to reach this position due to the recess 71 in the fixed blade 67, through which the free end of the separator element 44 extends, and by the presence of the recess 21 of the rotatable blade 20 which, by means of the drive train 38 is rotated in such a way that it is perfectly aligned with the fixed blade 67 at the end of the advancing stroke of the slide 24 so as to cut the strip 8 in perfect coincidence with the said perforation 10 thereof.

During its return stroke the slide 24 carries the edge 43 of the pusher element 41 back upstream of a new perforation 10 in the strip 8, whilst the actuator device 51 lowers the cam 50 in such a way as to separate the advancement device 40 displacing the tooth 45 of the separator element 44 out from the slot 16 in the plate 4.

We claim:

1. A device for feeding labels, in particular country stamps or sealing strips, to a utiliser machine, in particular a cigarette packaging machine, characterised by the fact that it comprises, in combination, a support body (2), an advancement track (7) for a continuous strip (8) of labels (9) extending along the said support body (2) and including an input portion (4) and an output portion (17) aligned with one another and together defining a separating slot (18), a slide (24) mounted on the said support body in a position adjacent the said track and movable with a reciprocating movement along it, an advancement device (40) carried by the said slide (24) and operable to cooperate with the said strip (8) to cause advancement thereof along the input portion (4) of the said track (7), a hollow shaft (53) carried rotatably by the slide (24) and operable to turn with a reciprocating movement about its axis in a determined phase relation with the movement of the said slide (24), a cutting element (20) supported by the said support body (2) in a position adjacent the said slot (18) and rotatable about its axis with a determined phase relation with the movement of the said slide (24);

the support body (2) having means to selectively and separately support thereon at one time either one of two interchangeable auxiliary units (60, 61) having means connectable to the said means on the support body (2) in a position facing the said slot (18);

one of the said units (61) including a fixed cutting element (67) which can be disposed facing the said slot (18) and having a cutting edge tangential both to the said track (7) and to the path of the said rotary cutting element (20); and the other said unit (60) including a fixed magazine (62) for labels (9) which can be positioned facing the said slot (18) and a rotary extractor element (65) for the said labels keyed on the said hollow shaft (53) and movable with this latter in the space between one end of the magazine (62) and the said track (7); the said extractor element (65) being connectable to a suction device by means of the said hollow shaft (53).

2. A device according to claim 1 in which the support body (2) means to selectively and separately support thereon one of two interchangeable auxiliary units (60, 61) comprises threaded holes (58);

the unit (61) comprising the fixed cutting element (67) having an attachment plate (69) having holes (70) which coincide with the threaded holes (58) in the support body (2); and the unit (60) comprising the magazine (62) having an attachment plate (63) having holes (64) which coincide with the threaded holes (58) in the support body (2).

3. A device according to claim 1, characterised by the fact that the said fixed cutting element includes a fixed blade (67) disposed in a substantially perpendicular position with respect to the track (7), and the said rotary cutting element includes a movable blade (20) disposed on the opposite side of the said track (7) with respect to the said fixed blade (67); each said blade (20, 67) having a substantially U-shape and being provided with a respective axial recess (21, 71) extending from a cutting edge and operable to be engaged by the said advancement device (40).

4. A device according to claim 3, characterised by the fact that said advancement device (40) includes a separator element (44) which can engage a surface of the said strip (8) successively to separate the edges of transverse perforations (10) formed along a central portion of the said strip (8) between each said label and the successive one, and a pusher element (41) the end (43) of which is operable to engage the separated edges of the said perforations (10) in succession; the said pusher element (41) performing together with the said slide (24,) a feed stroke towards a final position in which the said edge (43) coincides with the cutting edges of the said fixed and movable blades (20, 67).

5. A device according to claim 1, characterised by the fact that the said other unit (60) further comprises at least two strips (66) connectable to the said slide (24) on opposite sides of the said extractor element (65) and tangential to the said end of the said magazine (62).

* * * * *